US010607559B2

(12) United States Patent
Chen

(10) Patent No.: US 10,607,559 B2
(45) Date of Patent: Mar. 31, 2020

(54) DISPLAY METHOD AND DISPLAY DEVICE

(71) Applicants: HKC Corporation Limited, Shenzhen (CN); Chongqing HKC Optoelectronics Technology Co., ltd., Chongqing (CN)

(72) Inventor: Yu-Jen Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 119 days.

(21) Appl. No.: 15/855,414

(22) Filed: Dec. 27, 2017

(65) Prior Publication Data

US 2018/0261179 A1 Sep. 13, 2018

Related U.S. Application Data

(63) Continuation of application No. PCT/CN2017/089087, filed on Jun. 20, 2017.

(30) Foreign Application Priority Data

Mar. 10, 2017 (CN) ..... 2017 1 0142949

(51) Int. Cl.
*G09G 5/10* (2006.01)
*G09G 3/36* (2006.01)

(52) U.S. Cl.
CPC ... *G09G 3/3677* (2013.01); *G09G 2310/0213* (2013.01); *G09G 2320/0295* (2013.01); *G09G 2330/021* (2013.01)

(58) Field of Classification Search
USPC ..... 345/100, 76, 89, 690, 691; 348/51
See application file for complete search history.

(56) References Cited

U.S. PATENT DOCUMENTS

2006/0082523 A1* 4/2006 Guo ..... G09G 3/3233 345/76
2006/0214897 A1* 9/2006 Murai ..... G09G 3/2011 345/89
2006/0284896 A1* 12/2006 Shen ..... G09G 3/2007 345/690
2013/0169703 A1* 7/2013 Mizusako ..... G09G 5/10 345/691
2016/0173862 A1* 6/2016 Huang ..... G09G 3/2003 348/51
2017/0213501 A1* 7/2017 Lim ..... G09G 3/2092 345/100

* cited by examiner

*Primary Examiner* — Thuy N Pardo
(74) *Attorney, Agent, or Firm* — WPAT, PC

(57) ABSTRACT

The present application discloses a display method and a display device, the display method includes analyzing and acquiring the gray scale voltage corresponding to the row image data in the image data by receiving the image data of the image to be displayed, sorting the row image data according to the gray scale voltage and generating the sorting label, sequentially scanning the display device by the sorting label of the gate lines to display the image to be displayed. This method can reduce the voltage switching frequency, thereby reducing the power consumption of the display device.

20 Claims, 5 Drawing Sheets

DISPLAY METHOD AND DISPLAY DEVICE

FIELD OF THE DISCLOSURE

The disclosure relates to a display technology field, and more particularly to a display method and display device.

BACKGROUND

At present, the image of the liquid crystal display device are displayed by progressive scanning, that is, the gate lines of the display device are sequentially turned on according to the scanning information, the capacitance of each row of pixels is charged through the data lines. When the voltage of the charging is different, the gray scale present by the pixel is different, and when the pixel unit of the current row is charged, the pixel unit of the other row keeps the charged potential through the storage capacitor, after all the rows are charged to display one frame of complete image. Wherein, the charge and discharge of the data line will produce power consumption, the power consumption P=½CFV2 (C is for the capacitance, F is for the voltage switching frequency, V is for the voltage), especially when the image by the display device is an overload image, the voltage switching frequency F is larger, so that the display device has a large power consumption, when serious, the driving chip may be damaged due to high temperature.

SUMMARY

An embodiment of the present application provides a display method and a display device, the display method can be used to the display device to reduce the power consumption of the display device.

In the first aspect, A display method is provided, the display method used to a display device, including:

Receiving an image data of an image to be displayed;

Acquiring a gray scale voltage corresponding to a row image data in the image data;

Sorting the row image data according to the gray scale voltage and generating a sorting label; and Scanning gate lines of a display device sequentially according to the sorting label to display the image to be displayed.

In the display method of the present application, before the step of acquiring the gray scale voltage corresponding to the row image data in the image data, further including:

Judging whether the image data of the image to be displayed being the image data of an overload image or not;

Acquiring the gray scale voltage corresponding to the row image data in the image data, if the image data of the image to be displayed being the image data of the overload image.

In the display method of the present application, the step of sorting the row image data according to the gray scale voltage and generating the sorting label, including: sorting of the row image data and generating the sorting label according to the gray scale voltage from large to small values.

In the display method of the present application, the step of acquiring the gray scale voltage corresponding to the row image data in the image data, further including:

In the display method of the present application, the step of sorting of the row image data and generating the sorting label according to the gray scale voltage from large to small values, including:

Judging whether a plurality of row image data in the image data having the row image data with the same value of the gray scale voltage;

Sorting the row image data with the same value of the gray scale voltage in accordance with an order of original image row numbers, if the plurality of the row image data in the image data having the row image data with the same value of the gray scale voltage, wherein the original image row numbers are the row numbers of the row image data in the image data.

In the display method of the present application, the step of judging whether the image data of the image to be displayed is the image data of an overload image or not, including:

Judging whether the ratio of the number of overload sub-pixels to the total number of sub-pixels in the image to be displayed exceeding a preset ratio or not, wherein the overload sub-pixels are the sub-pixel with a difference of the gray-scale values between its adjacent sub-pixel exceeding a preset threshold of each row of the sub-pixels;

Determining the image data of the image to be displayed being the image data of the overload image, if the ratio exceeding the preset ratio.

The second aspect, a display device is provided, the display device including:

A receiving module for receiving an image data of an image to be displayed;

An acquisition module for acquiring a gray scale voltage corresponding to a row image data in the image data;

A sorting generation module for sorting the row image data according to the gray scale voltage and generating a sorting label;

A scanning display module for sequentially scanning gate lines of the display device according to the sorting label to display the image to be displayed.

In the display device of the present application, the display device further including a judgment module;

The judgment module for judging whether the image data of the image to be displayed being the image data of an overload image or not;

The acquisition module for acquiring the gray scale voltage corresponding to the row image data in the image data, if the image data of the image to be displayed is the image data of the overload image.

In the display device of the present application, the sorting generation module is for sorting of the row image data and generating the sorting label according to the gray scale voltage from large to small values.

In the display device of the present application, the sorting generation module further including:

A voltage judgment sub-module for judging whether a plurality of row image data in the image data having the row image data with the same value of the gray scale voltage;

A sorting sub-module for sorting the row image data with the same value of the gray scale voltage in accordance with an order of original image row numbers, if the plurality of the row image data in the image data having the row image data with the same value of the gray scale voltage, wherein the original image row numbers are the row number of the row image data in the image data.

In the display device of the present application, the judgment module further including:

A judgment sub-module for judging whether the ratio of the number of overload sub-pixels to the total number of sub-pixels in the image to be displayed exceeding a preset ratio or not, wherein the overload sub-pixels are the sub-pixel with a difference of the gray-scale values between its adjacent sub-pixel exceeding a preset threshold of each row of the sub-pixels;

A determination sub-module for determining the image data of the image to be displayed being the image data of the overload image, if the ratio exceeding the preset ratio.

The embodiment of the present application analyzes and acquires the gray scale voltage corresponding to the row image data in the image data by receiving the image data of the image to be displayed, sorting the row image data according to the gray scale voltage and generating a sorting label, sequentially scanning and turning on the gate lines of the display device according to the sorting labels to display the image to be displayed. The display method changes the display mode by conventional top-bottom row by row scanning, and uses a new sorting label to perform scanning according to the sorting of the value of the voltage level, reducing the voltage switching frequency and thereby reducing the power consumption of the display device.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
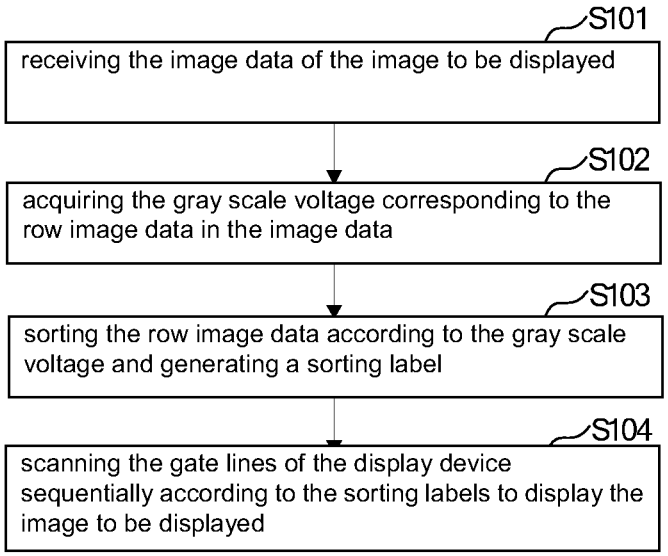
FIG. 1 is a schematic flow diagram of a display method provided by an embodiment of the present application.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

In the description of the disclosure, is should be noted that, unless otherwise clearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows.

Referring to FIG. 1, FIG. 1 is a schematic flow diagram of a display method provided by the embodiments of the present application. The display method is used to a display device, and the display method can reduce the power consumption of the display device, without increasing the cost of the display device. The display method is specifically operated in the panel driving board (TCON) of the display device, and the display method is operated by TCON to drive the display panel of the display device. As shown in FIG. 1, the display method includes steps S101 to S104.

S101, receiving the image data of the image to be displayed.

In the embodiment of the present application, receiving the image data of the image to be displayed is specifically as receiving the image data of the image to be displayed outputted from the front end by the TCON of the display device, because the display image of the display device is a frame-by-frame display, therefore the data outputted from the front end received by the TCON is also a frame-by-frame image data, image data of one to two frames is stored in the memory of TCON, to facilitate the control IC of TCON to perform the analysis and processing of the image data of one to two frames, so that the following continue to perform the following step.

It is to be noted that, when the TCON is performed the over driver, image data of one to two frames to be displayed is generally need to be stored, so this method does not need to increase the memory capacity, it does not increase the hardware cost of the display device.

S102, acquiring the gray scale voltage corresponding to the row image data in the image data.

In the embodiment of the present application, the image data is composed of a plurality of pixel data, and the data of the pixel in the same row is called row image data, acquiring the gray scale voltage corresponding to the row image data in the image data means the gray scale voltage of the image data by the unit of row, the gray scale voltage is not actually the voltage, but the binary data, but the value of the binary data shows liner relationship with the value of the actual gray scale voltage, the value of the corresponding gray level voltage can be judged according to the high and low data of 01, so that the gray scale voltage can be expressed by the binary data of the image data, so that the acquiring of the gray scale voltage corresponding to the row image data in the image data can be achieved.

It should be noted that, the gray scale voltage can be an average value of the gray scale voltage of all the pixels in each row of the image data, or it can be other expression forms, such as a square root or a mean square error form, and is not limited thereto.

S103, sorting the row image data according to the gray scale voltage and generating a sorting label.

In the embodiment of the present application, sorting the row image data according to the gray scale voltage and generates a sorting label specifically is adapted by sorting the image data according to the average value of the gray scale voltage of the row image data. Specific, to sort from large to small can be used, to sort from small to large can also be used, or other sorting, and is not limited thereto.

If the sorting from large to small is adapted, for example, the highest gray scale voltage in the plurality of row image data is aV analyzed by the control IC of the TCON, the row image data corresponding to the highest gray scale voltage is the nth row in the original image data, the nth row is labeled as 1; the second highest gray scale voltage in the plurality of row image data is bV analyzed by the control IC of the TCON, the row image data corresponding to the second highest gray scale voltage is the mth row in the original image data, the mth row is labeled as 2; followed to complete by all the row image data are labeled, wherein a, b is for the specific value, n, m is a positive integer, V is for voltage volts. The newly labeled numbers 1, 2, 3 and the like are the sorting labels.

S104, scanning the gate lines of the display device sequentially according to the sorting labels to display the image to be displayed.

Figure 2:
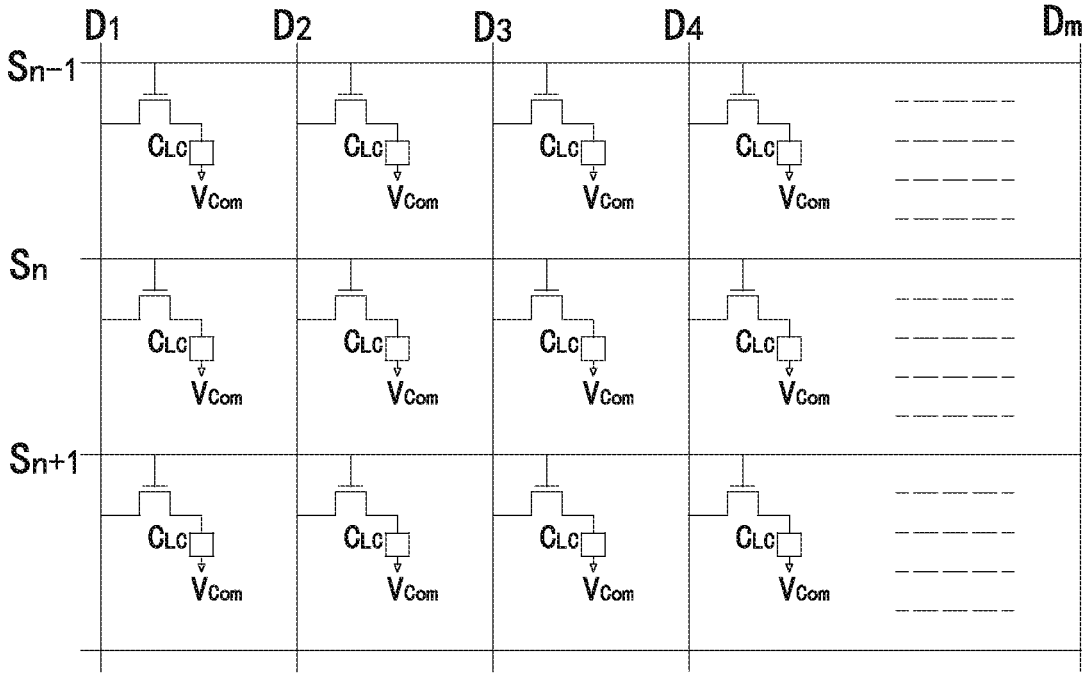
FIG. 2 is a schematic diagram of an array circuit of a display device provided in an embodiment of the present application.

The scanning display method of the conventional display device is performed in succession scanning the gate lines from the top to the bottom of the display device. As shown in FIG. 2, FIG. 2 is a schematic diagram of an array circuit of a display device provided by the present application, array circuit includes a plurality of pixel units defined by the gate lines Sn (also referred to as a scanning rows) and data lines Dm, all of each pixel unit includes a TFT transistor and a LC capacitor formed by the pixel electrode and the common electrode, the TFT is performed the turned on or off according to the gate line scanning signal to achieve charging the LC capacitor through the data line. From top to bottom scanning row by row, that is, first scanning S1, turning on the TFT connected to the gate line S1, charging the LC capacitor in the S1 row through the data line Dm (Dm refers to all of the data lines), following scanning S2, until scanning to the last gate line to complete the display of a frame. The disadvantage of scanning row by row is that it generate large power consumption when charging and discharging of the data line of the display device, the power consumption is expressed as: P=½CFV2 (C is the capacitance capacity, F is the voltage switching frequency, V is Voltage), by the expression can be seen, the power consumption of related to the voltage switching frequency, the greater the voltage switching frequency, the greater the power consumption. When the normal image is displayed, the power consumption is not very high; but when overload image is displayed, since the value of the voltage switching frequency F of the overload image is larger, it causes the display device to generate larger power consumption, when serious, the driving chip may be damaged due to high temperature.

In the embodiment of the present application, the gate lines of the display device are sequentially scanned according to the sorting labels to display the image to be displayed. Since the row image data is reordered according to the gray scale voltage, the issue of the too larger of the voltage switching frequency is avoided, therefore the issue of the power consumption of the display device is effectively reduced, and even when the image is displayed by the display device, no excessive power consumption occurs. Therefore, the display method not only reduce the power consumption of the display device, and it is possible to protect the driver chip from being burned out.

The above-described embodiment of the present application analyzes and acquires the gray scale voltage corresponding to the row image data in the image data by receiving the image data of the image to be displayed, sorting the row image data according to the gray scale voltage and generating a sorting label, sequentially scanning and turning on the gate lines of the display device according to the sorting labels to display the image to be displayed. The display method changes the display mode by conventional top-bottom row by row scanning, and uses a new sorting label to perform scanning according to the sorting of the value of the voltage level, reducing the voltage switching frequency and thereby reducing the power consumption of the display device.

Figure 3:
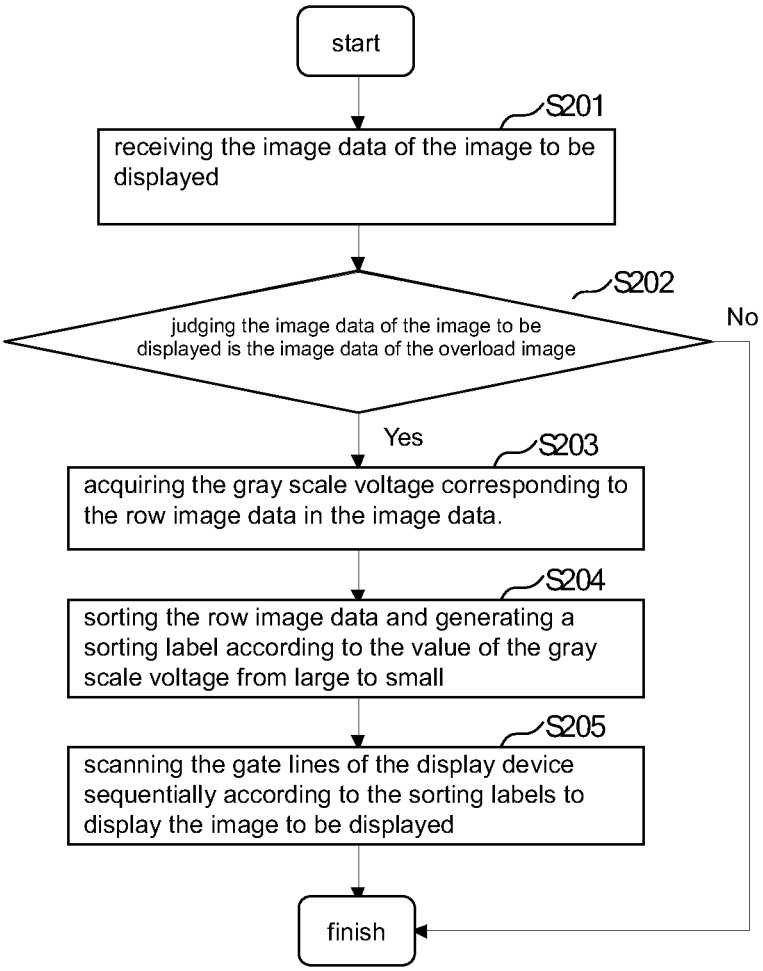
FIG. 3 is another schematic flow diagram of a display method provided by the embodiments of the present application.

Referring to FIG. 3, FIG. 3 is another schematic flow diagram of a display method provided by the embodiments of the present application. The display method is used to a display device, the display device be a display of a computer, but is not limited to a display of a computer. In order to facilitate a better understanding of the present application, in the present embodiment, a display for the computer will be described in detail as an example. As shown in FIG. 3, the display method includes steps S201 to S205.

S201, receiving the image data of the image to be displayed.

In the embodiment of the present application, receiving the image data of the image to be displayed is understood as receiving the image data be displayed by the display device outputted from the computer. Specifically is the image data be displayed is received by the panel driving board of the display device outputted from the box of the computer. The image data is binary data. After receiving the image data of the image to be displayed by the panel driving board of the display device outputted from the box of the computer, the image data is stored in the memory of the panel driving board, image data of one to two frames to be displayed is generally need to be stored, so this method does not need to increase the memory capacity.

S202, judging the image data of the image to be displayed is the image data of the overload image or not.

In the embodiment of the present application, since the power consumption generated by the display device is mainly caused by the image properties of the image to be displayed, for example, when the overload image is displayed, it will cause the display device to generate a larger power consumption. So the display method can be used to display some special images similar to the overload image, the display method can also be used in normal image. The display method and the conventional display method can used in combination to obtain better performance. Therefore, when the display method is used, it is necessary to determine whether or not the image data of the image to be displayed is the image data of the overload image, and generate a judging result; If the result of the determination is an overload image, step S203 is performed. If the result of the judgment is not the overload image, the display mode of scanning row by row is performed to display the image to be displayed.

Figure 4:
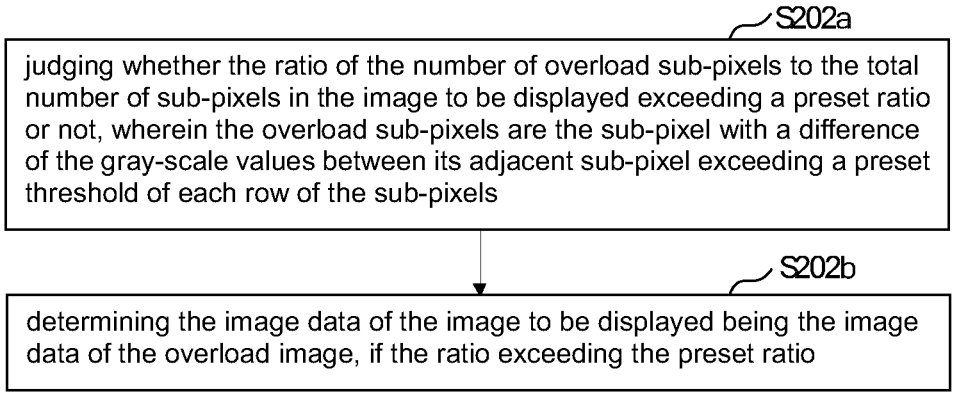
FIG. 4 is a schematic flow diagram of the sub-step in step S202 of FIG. 3.

Wherein, a method of judging whether or not the image data is overload image is shown in FIG. 4, that is, the step S202 includes sub-steps S202*a* and S202*b*.

S202*a*: judging whether the ratio of the number of an overload sub-pixels to the total number of sub-pixels in the image to be displayed exceeds the preset ratio or not, wherein the overload sub-pixel is the sub-pixel of each of the rows with a difference of the gray-scale values between its adjacent sub-pixel exceeds a preset threshold.

Figure 5:
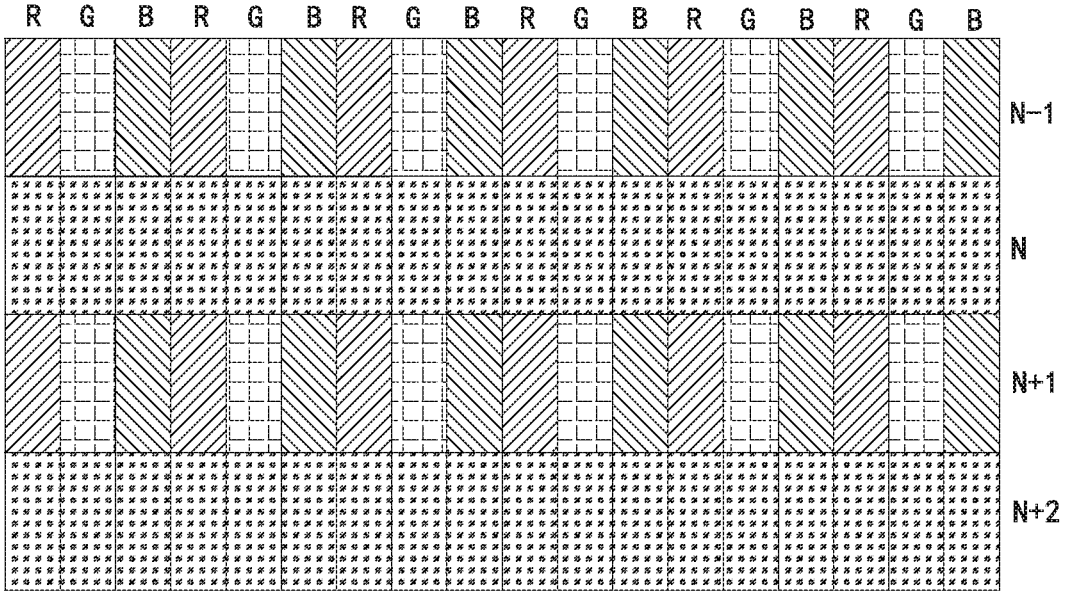
FIG. 5 is a schematic diagram of the performance of the image by the overload display in the conventional technology.

Specifically, the preset ratio and the preset threshold are specifically set in accordance with the actual value of the power consumption generated by the display device, the different types of display devices are not only the same. For example, taking FIG. 5 as an embodiment of the overload image to proceed the detail description. FIG. 5 is one of the forms of the overload image. In FIG. 5, the pixel in N−1th row represents the bright pixels, the pixels in Nth row represents the dark pixels, the N+1th row represents the bright pixels, and the N+2th row represents the dark pixels, the image of the entire display device are all bright and dark rows of pixels alternately formed, because the pixels in rows are bright and dark alternately, the ratio of the number of the overload sub-pixels to the total number of sub-pixels in the image to be displayed will reach 100%.

S202*b*, if the ratio exceeds the preset ratio, it is determined that the image data of the image to be displayed is the image data of the overload image.

Wherein, in FIG. 5, the image data displayed in the display panel satisfies the condition that the ratio of the number of an overload sub-pixels to the total number of sub-pixels in the image to be displayed exceeds the preset ratio. Therefore, the image shown in FIG. 5 is the overload image.

Figure 6:
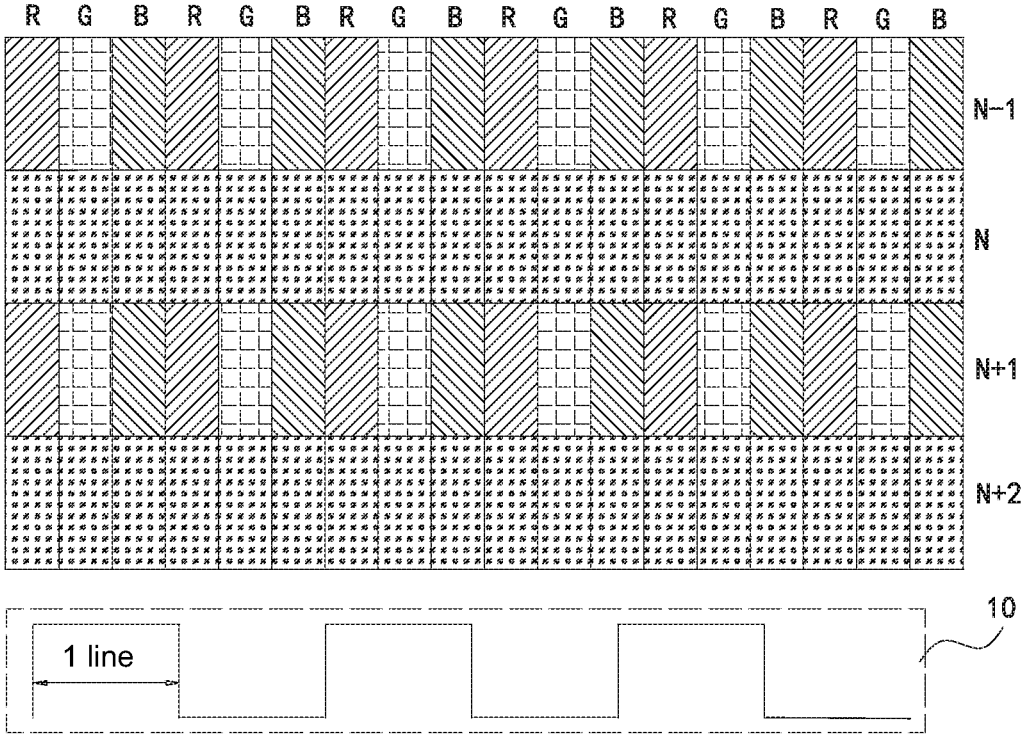
FIG. 6 is a schematic diagram of a driving signal of data line by the overload display in the conventional technology.

Besides, in order to explain in more detail that the overload image will cause the display device to generate a larger power consumption. Referring to FIG. 6, FIG. 6 is a schematic diagram of a driving signal of data line by the overload display in the conventional technology; As shown in FIG. 6, since the overload image is displayed bright and dark alternately by the gate lines from the top to the bottom, the driving signal 10 corresponding to the data line will use a similar high and low level driving signal, and scanning sequentially by using the high and low level driving signal leads to a larger voltage switching frequency, resulting in greater power consumption.

S203, acquiring the gray scale voltage corresponding to the row image data in the image data.

In the embodiment of the present application, if image data of the image to be displayed is the image data of the overload image, the gray scale voltage corresponding to the row image data in the image data is acquired. Specifically, acquiring the gray scale voltage corresponding to the row image data in the image data means the gray scale voltage of the image data by the unit of row, the gray scale voltage is not actually the voltage, but the binary data, but the value of the binary data shows liner relationship with the value of the actual gray scale voltage, the value of the corresponding gray level voltage can be judged according to the high and low data of 01, so that the gray scale voltage can be expressed by the binary data of the image data, so that the acquiring of the gray scale voltage corresponding to the row image data in the image data can be achieved.

It should be noted that, the gray scale voltage can be an average value of the gray scale voltage of all the pixels in each row of the image data, or it can be other expression forms, such as a square root or a mean square error form, and is not limited thereto.

S204, Sorting the row image data according to the value of the gray scale voltage from large to small and generating a sorting label.

In the embodiment of the present application, the sorting is performed according to the gray scale voltage from large to small. For example, the highest gray scale voltage in the plurality of row image data is aV analyzed by the control IC of the TCON, the row image data corresponding to the highest gray scale voltage is the nth row in the original image data, the nth row is labeled as 1; the second highest gray scale voltage in the plurality of row image data is bV analyzed by the control IC of the TCON, the row image data corresponding to the second highest gray scale voltage is the mth row in the original image data, the mth row is labeled as 2; followed to complete by all the row image data are labeled, wherein a, b is for the specific value, n, m is a positive integer, V is for voltage volts. The newly labeled numbers 1, 2, 3 and the like are the sorting labels.

Figure 7:
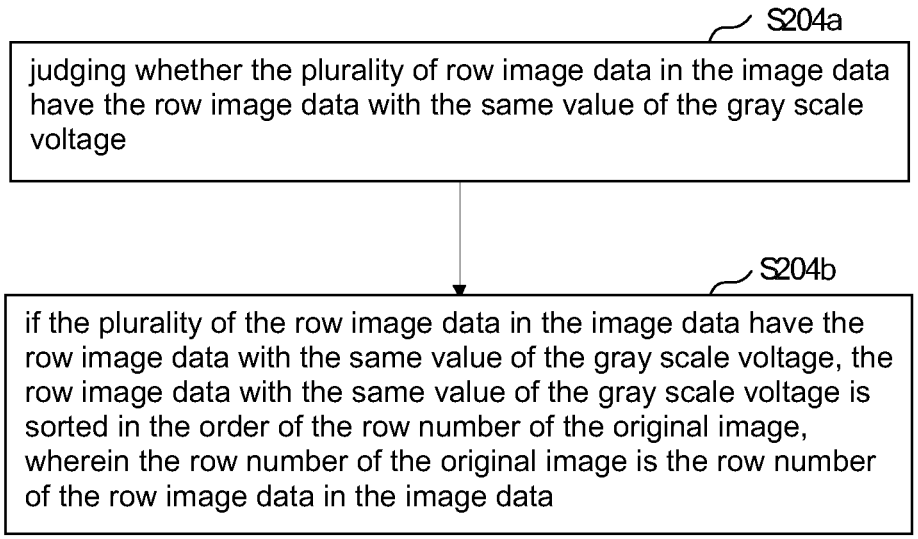
FIG. 7 is a schematic flow diagram of the sub-step in step S204 of FIG. 3.

In addition, it is possible to happen the situation that the gray scale voltages of the different row image data can be the same as each other. As shown in FIG. 7, step S204, that is sorting the row image data according to the value of the gray scale voltage from large to small and generating a sorting label, specifically including sub-steps S204*a* and S204*b*. Wherein, S204*a*: judging whether the plurality of row image data in the image data have the row image data with the same value of the gray scale voltage; S204*b*, if the plurality of the row image data in the image data have the row image data with the same value of the gray scale voltage, the row image data with the same value of the gray scale voltage is sorted in the order of the row number of the original image, wherein the row number of the original image is the row number of the row image data in the image data. For example, if the image data of the nth row, n+3th row, n+8th row have the highest voltage, the sorting of labels is in accordance with the order of the three rows in the original image, that is the nth row is labeled as 1, the n+3th row is labeled as 2, and the n+8th row is labeled as 3. It is possible to solve the problem of how to sort the label of the row image data with the same value of the gray scale voltage in the image data.

S205, scanning the gate lines of the display device sequentially according to the sorting labels to display the image to be displayed.

In the embodiment of the present application, scanning the gate lines of the display device sequentially according to the sorting labels to display the image to be displayed, since the row image data is reordered according to the gray scale voltage, the issue of the too larger of the voltage switching frequency is avoided, therefore the issue of the power consumption of the display device is effectively reduced, and even when the image is displayed by the display device, no excessive power consumption occurs. Therefore, the display method not only reduce the power consumption of the display device, and it is possible to protect the driver chip from being burned out.

Figure 8:
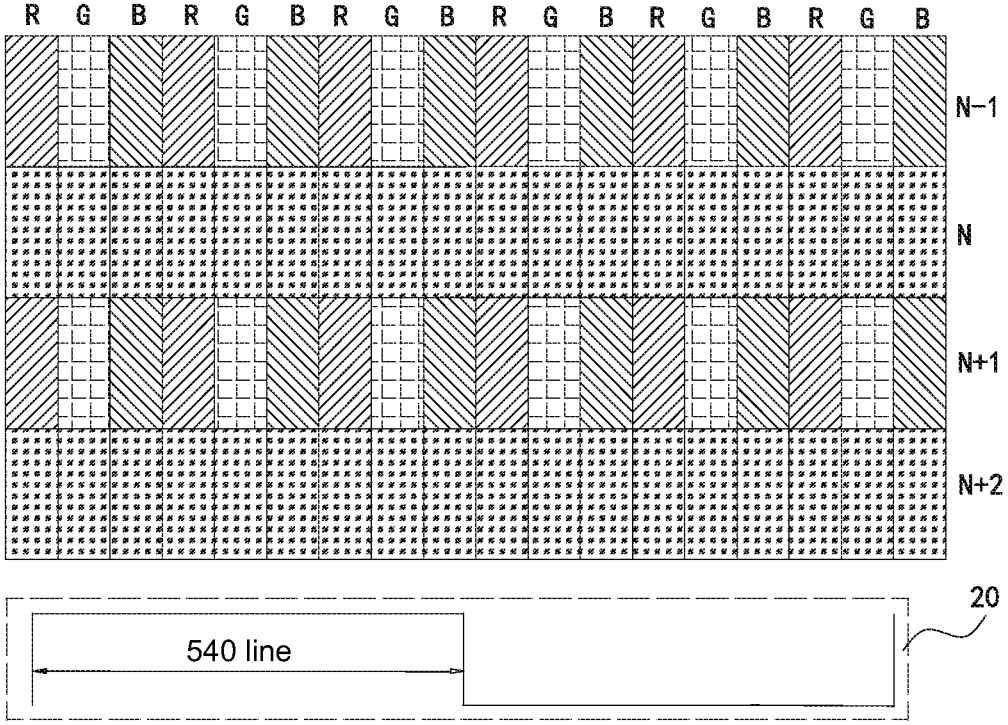
FIG. 8 is a schematic diagram of a driving signal of data line by the overload display of the use of the display method provided by the embodiment of the present application.

Specifically, as shown in FIG. 8, FIG. 8 is a schematic diagram of a driving signal of data line by the overload display of the use of the display method provided by the embodiment of the present application. Since the row image data is reordered according to the gray scale voltage, so that the driving signal of the data line does not use the driving information 10 similar to the high and low levels in FIG. 6, but the driving signal 20 is used, and if there are 1080 gate lines (scanning lines), when display the overload image by using the display method of the present application, 540 high-level is continuously outputted, and 540 low-level is continuously outputted, the value of the of the voltage switching frequency is greatly reduced, therefore the power consumption problem of the display device is effectively reduced.

The above-described embodiment of the present application receives the image data of the image to be displayed, judging whether the image data is the image data of the overload image or not; if yes, analyzing and acquiring the gray scale voltage corresponding to the row image data in the image data, sorting the row image data according to the gray scale voltage and generating a sorting label, and sequentially scanning and turning on the gate lines of the display device according to the sorting labels to display the image to be displayed. The display method changes the display mode by conventional top-bottom row by row scanning, and uses a new sorting label to perform scanning according to the sorting of the value of the voltage level, reducing the voltage switching frequency and thereby reducing the power consumption of the display device.

Figure 9:
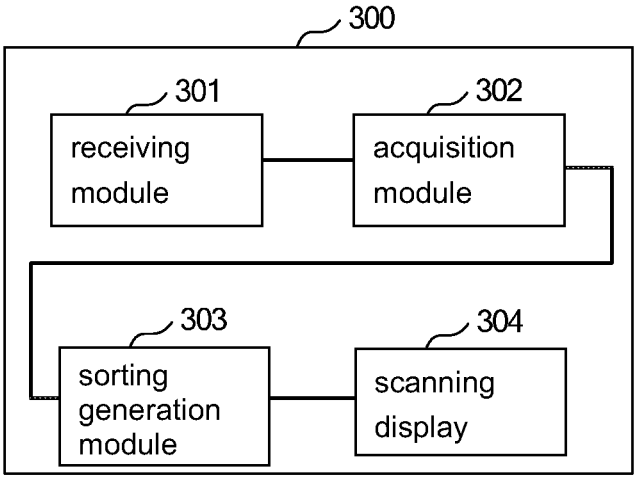
FIG. 9 is a schematic block diagram of a display device provided in an embodiment of the present application.

Referring to FIG. 9, FIG. 9 is shown a schematic block diagram of a display device provided by the embodiment of the present application. The display device operates the display method in the above-described embodiment, and a better display effect has been achieved, such as for the overload image to reduce the power consumption problem. As shown in FIG. 9, the display device includes a receiving module 301, an acquisition module 302, a sorting generation module 303, and a scanning display module 304.

The receiving module 301 is for receiving the image data of the image to be displayed. Specifically, is receiving the image data of one to two frames of the image to be displayed outputted from the front end, because the display image of the display device is a frame-by-frame display, therefore the data outputted from the front end is also received the frame-by-frame image data. It also can include a storage module for storing some of the image data of one to two frames in the memory of TCON, to facilitate the control IC of TCON to perform the analysis and processing of the image data of one to two frames, since when the TCON is performed the over driver, image data of one to two frames to be displayed is generally need to be stored, the memory on the TCON of the conventional display device can satisfy the capacity demand, so it does not increase the hardware cost of the display device to store image data of one to two frames for facilitating follow-up analysis.

Acquisition module 302 is for acquiring the gray scale voltage corresponding to the row image data in the image data. Specifically is to acquire the gray scale voltage corresponding to the row image data in the image data, refers to the gray scale voltage of the image data in units of row, gray scale voltage is not actual voltage, but the binary data, but the value of the binary data shows liner relationship with the value of the actual gray scale voltage, the value of the corresponding gray level voltage can be judged according to the high and low data of 01, so that the gray scale voltage can be expressed by the binary data of the image data, so that the acquiring of the gray scale voltage corresponding to the row image data in the image data can be achieved. It should be noted that, the gray scale voltage can be an average value of the gray scale voltage of all the pixels in each row of the image data, or it can be other expression forms, such as a square root or a mean square error form, and is not limited thereto.

A sorting generation module 303 is for sorting the row image data according to the gray scale voltage and generating a sorting label. Wherein, sorting the row image data according to the gray scale voltage and generates a sorting label specifically is adapted by sorting the image data according to the average value of the gray scale voltage of the row image data. Specific, to sort from large to small can be used, to sort from small to large can also be used, or other sorting, and is not limited thereto. If the sorting from large to small is adapted, for example, the highest gray scale voltage in the plurality of row image data is aV analyzed by the control IC of the TCON, the row image data corresponding to the highest gray scale voltage is the nth row in the original image data, the nth row is labeled as 1; the second highest gray scale voltage in the plurality of row image data is bV analyzed by the control IC of the TCON, the row image data corresponding to the second highest gray scale voltage is the mth row in the original image data, the mth row is labeled as 2; followed to complete by all the row image data are labeled, wherein a, b is for the specific value, n, m is a positive integer, V is for voltage volts. The newly labeled numbers 1, 2, 3 and the like are the sorting labels.

The scanning display module 304 is for sequentially scanning the gate lines of the display device according to the sorting labels to display the image to be displayed. Wherein, the gate lines of the display device are sequentially scanned according to the sorting labels to display the image to be displayed. Since the row image data is reordered according to the gray scale voltage, the issue of the too larger of the voltage switching frequency is avoided, therefore the issue of the power consumption of the display device is effectively reduced, and even when the image is displayed by the display device, no excessive power consumption occurs. Therefore, the display method not only reduce the power consumption of the display device, and it is possible to protect the driver chip from being burned out.

Figure 10:
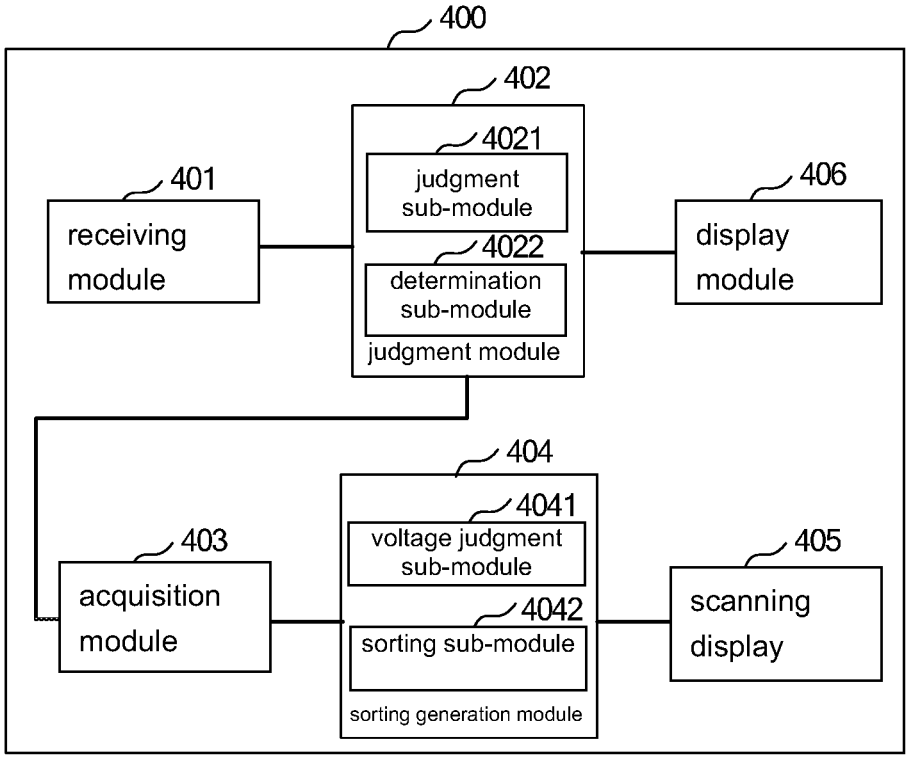
FIG. 10 is another schematic block diagram of a display device provided in the embodiments of the present application.

Please referring to FIG. 10, FIG. 10 is another schematic block diagram of a display device provided by the embodiment of the present application. The display device operates the display method in the above-described embodiment, and a better display effect has been achieved, such as for the overload image to reduce the power consumption problem. As shown in FIG. 10, the display device 400 includes a receiving module 401, a judgment module 402, an acquisition module 403, a sorting generation module 404, a scanning display module 405 and a display module 406.

The receiving module 401 is for receiving the image data of the image to be displayed. Wherein, specifically is receiving the image data of the image to be displayed outputted from the box of the computer, the image data is stored in the memory of the panel driving board, image data of one to two frames to be displayed is generally stored, so the capacity of the memory of the panel driving board does not need to be increased.

A judgment module 402 is for judging whether the image data of the image to be displayed is the image data of the overload image or not. Wherein, when the display image is the overload image, since the value of the voltage switching frequency F of the overload image is larger, it causes a larger power consumption of the display device, and the driving chip may be damaged due to the high temperature. Therefore, it is necessary to first determine whether or not the image data of the image to be displayed is the image data of the overload image. Based on this, the judgment module 402 includes a judgment sub-module 4021 and a determination sub-module 4022.

Specifically, the judgment sub-module 4021 is used to determine whether the ratio of the number of an overload sub-pixels to the total number of sub-pixels in the image to be displayed exceeds the preset ratio or not, wherein the overload sub-pixel is the sub-pixel of each of the rows with difference of the gray-scale values between its adjacent sub-pixel exceeds a preset threshold; the determination sub-module 4022 is used to determine that the image data of the image to be displayed is the image data of the overload image, if the ratio exceeds the preset ratio.

Wherein, the judgment module 402 is used to determine whether or not the image data of the image to be displayed is the image data of the overload image, and generate the judgment result. If the result of the determination is the overload image, the acquisition module 403 is called, and if the result of the judgment is not the overload image, the display module 406 is called.

The acquisition module 403 is for acquiring the gray scale voltage corresponding to the row image data in the image data, if image data of the image to be displayed is the image data of the overload image. Specifically, if image data of the image to be displayed is the image data of the overload image, the gray scale voltage corresponding to the row image data in the image data is acquired. Specifically, acquiring the gray scale voltage corresponding to the row image data in the image data means the gray scale voltage of the image data by the unit of row, the gray scale voltage is not actually the voltage, but the binary data, but the value of the binary data shows liner relationship with the value of the actual gray scale voltage, the value of the corresponding gray level voltage can be judged according to the high and low data of 01, so that the gray scale voltage can be expressed by the binary data of the image data, so that the acquiring of the gray scale voltage corresponding to the row image data in the image data can be achieved.

The sorting generation module 404 is for sorting the row image data according to the gray scale voltage and generating a sorting label. Wherein, the sorting is performed according to the gray scale voltage from large to small. For example, the highest gray scale voltage in the plurality of row image data is aV analyzed by the control IC of the TCON, the row image data corresponding to the highest gray scale voltage is the nth row in the original image data, the nth row is labeled as 1; the second highest gray scale voltage in the plurality of row image data is bV analyzed by the control IC of the TCON, the row image data corresponding to the second highest gray scale voltage is the mth row in the original image data, the mth row is labeled as 2; followed to complete by all the row image data are labeled, wherein a, b is for the specific value, n, m is a positive integer, V is for voltage volts. The newly labeled numbers 1, 2, 3 and the like are the sorting labels.

In addition, it is possible to happen the situation that the gray scale voltages of the different row image data can be the same as each other. Based on this, the sorting generation module 404 includes voltage judgment sub-module 4041 and the sorting sub-module 4042.

Specifically, the voltage judgment sub-module 4041 is for judging whether the plurality of row image data in the image data have the row image data with the same value of the gray scale voltage; the sorting sub-module 4042 is for sorting the row image data with the same value of the gray scale voltage in the order of the row number of the original image, if the plurality of the row image data in the image data have the row image data with the same value of the gray scale voltage, wherein the row number of the original image is the row number of the row image data in the image data.

The scanning display module 405 is for sequentially scanning the gate lines of the display device according to the sorting labels to display the image to be displayed. Wherein, the gate lines of the display device are sequentially scanned according to the sorting labels to display the image to be displayed. Since the row image data is reordered according to the gray scale voltage, the issue of the too larger of the voltage switching frequency is avoided, therefore the issue of the power consumption of the display device is effectively reduced, and even when the image is displayed by the display device, no excessive power consumption occurs. Therefore, the display method not only reduces the power consumption of the display device, and it is possible to protect the driver chip from being burned out.

The display module 406 is for displaying the display image to be displayed by the display method of scanning row by row. Wherein, the normal image can also display the image to be displayed using the display method of the scanning row by row, so that the conventional display method and the display method of the present application can used in combination to obtain better performance.

The display device according to the embodiment of the present application is to display the image to be displayed by sequentially scanning the gate lines according to the sorting labels, since the row image data is reordered according to the gray scale voltage, the issue of the too larger of the voltage switching frequency is avoided, therefore the issue of the power consumption of the display device is effectively reduced, and even when the image is displayed by the display device, no excessive power consumption occurs. Therefore, the display method not only reduces the power consumption of the display device, and it is possible to protect the driver chip from being burned out.

It will be apparent to those skilled in the art that the specific processes of the described devices and modules described above can be referred to the corresponding processes in the foregoing embodiment of the method for the sake of convenience and simplicity of description, and will not be described further herein. The steps in the method of the present application may be sequentially adjusted, merged and deleted according to actual needs.

The units or modules in the terminal of the embodiments of the present application may be combined, divided and deleted according to actual needs.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A display method used to a display device, comprising:

receiving an image data of an image to be displayed and storing the image data in a memory of a panel driving board;

acquiring a gray scale voltage corresponding to each of rows of image data in the image data to thereby obtain a plurality of gray scale voltages respectively corresponding to the rows of image data in the image data, wherein each of the plurality of gray scale voltages is determined by gray scale voltages of pixels in corresponding one of the rows of the image data;

sorting the row image data according to the plurality of gray scale voltages and generating sorting labels representative of a scanning order of gate lines; and scanning the gate lines according to the sorting labels to display the image to be displayed.

2. The display method according to claim 1, wherein before the step of acquiring a gray scale voltage corresponding to each of rows image data in the image data to thereby obtain a plurality of gray scale voltages respectively corresponding to the rows of image data in the image data, further comprising:

judging whether the image data of the image to be displayed being the image data of an overload image or not; and acquiring the gray scale voltage corresponding to the row image data in the image data, if the image data of the image to be displayed being the image data of the overload image.

3. The display method according to claim 1, wherein the step of sorting the row image data according to the plurality of gray scale voltages and generating sorting labels representative of a scanning order of gate lines, comprising: sorting of the row image data and generating the sorting labels according to the plurality of gray scale voltages from large to small values.

4. The display method according to claim 1, wherein the step of sorting the row image data according to the plurality of gray scale voltages and generating sorting labels representative of a scanning order of gate lines, comprising: sorting of the row image data and generating the sorting labels according to the plurality of gray scale voltages from small to large values.

5. The display method according to claim 1, wherein the step of acquiring a gray scale voltage corresponding to each of rows image data in the image data to thereby obtain a plurality of gray scale voltages respectively corresponding to the rows of image data in the image data, wherein each of the plurality of gray scale voltages is determined by gray scale voltages of pixels in corresponding one of the rows of the image data, comprising: acquiring an average value of the gray scale voltage of all pixels of the image data in each row and setting the average value to be the gray scale voltage corresponding to the row image data.

6. The display method according to claim 3, wherein the step of sorting of the row image data and generating the sorting labels according to the plurality of gray scale voltages from large to small values, comprising:

judging whether a plurality of row image data in the image data having the row image data with the same value of the plurality of gray scale voltages; and sorting the row image data with the same value of the plurality of gray scale voltages in accordance with an order of original image row numbers, if the plurality of the row image data in the image data having the row image data with the same value of the plurality of gray scale voltages, wherein the original image row numbers are the row numbers of the row image data in the image data.

7. The display method according to claim 2, wherein the step of judging whether the image data of the image to be displayed is the image data of an overload image or not, comprising:

judging whether the ratio of the number of overload sub-pixels to the total number of sub-pixels in the image to be displayed exceeding a preset ratio or not, wherein the overload sub-pixels are the sub-pixel with a difference of the gray-scale values between its adjacent sub-pixel exceeding a preset threshold of each row of the sub-pixels; and determining the image data of the image to be displayed being the image data of the overload image, if the ratio exceeding the preset ratio.

8. A display method used to a display device, comprising:

receiving an image data of an image to be displayed;

acquiring a gray scale voltage corresponding to each of rows of image data in the image data to thereby obtain a plurality of gray scale voltages respectively corresponding to the rows of image data in the image data, wherein each of the plurality of gray scale voltages is determined by gray scale voltages of pixels in corresponding one of the rows of the image data;

sorting the row image data according to the plurality of gray scale voltages and generating sorting labels representative of a scanning order of gate lines; and scanning the gate lines according to the sorting labels to display the image to be displayed.

9. The display method according to claim 8, wherein before the step of acquiring a gray scale voltage corresponding to each of rows image data in the image data to thereby obtain a plurality of gray scale voltages respectively corresponding to the rows of image data in the image data, further comprising:

judging whether the image data of the image to be displayed being the image data of an overload image or not; and acquiring the gray scale voltage corresponding to the row image data in the image data, if the image data of the image to be displayed being the image data of the overload image.

10. The display method according to claim 8, wherein the step of sorting the row image data according to the gray scale voltages and generating sorting labels representative of a scanning order of gate lines, comprising: sorting of the row image data and generating the sorting labels according to the plurality of gray scale voltages from large to small values.

11. The display method according to claim 8, wherein the step of sorting the row image data according to the gray scale voltages and generating sorting labels representative of a scanning order of gate lines, comprising: sorting of the row image data and generating the sorting labels according to the plurality of gray scale voltages from small to large values.

12. The display method according to claim 8, wherein the step of acquiring a gray scale voltage corresponding to each of rows image data in the image data to thereby obtain a plurality of gray scale voltages respectively corresponding to the rows of image data in the image data, wherein each of the plurality of gray scale voltages is determined by gray scale voltages of pixels in corresponding one of the rows of the image data, comprising: acquiring an average value of the gray scale voltage of all pixels of the image data in each row and setting the average value to be the gray scale voltage corresponding to the row image data.

13. The display method according to claim 10, wherein the step of sorting of the row image data and generating the sorting labels according to the plurality of gray scale voltages from large to small values, comprising:

judging whether a plurality of row image data in the image data having the row image data with the same value of the plurality of gray scale voltages; and sorting the row image data with the same value of the plurality of gray scale voltages in accordance with an order of original image row numbers, if the plurality of the row image data in the image data having the row image data with the same value of the plurality of gray scale voltages, wherein the original image row numbers are the row numbers of the row image data in the image data.

14. The display method according to claim 9, wherein the step of judging whether the image data of the image to be displayed is the image data of an overload image or not, comprising:

judging whether the ratio of the number of overload sub-pixels to the total number of sub-pixels in the image to be displayed exceeding a preset ratio or not, wherein the overload sub-pixels are the sub-pixel with a difference of the gray-scale values between its adjacent sub-pixel exceeding a preset threshold of each row of the sub-pixels; and determining the image data of the image to be displayed being the image data of the overload image, if the ratio exceeding the preset ratio.

15. A display device, comprising:

a receiving module for receiving an image data of an image to be displayed;

an acquisition module for acquiring a gray scale voltage corresponding to each of rows of image data in the image data to thereby obtain a plurality of gray scale voltages respectively corresponding to the rows of image data in the image data, wherein each of the plurality of gray scale voltages is determined by gray scale voltages of pixels in corresponding one of the rows of the image data;

a sorting generation module for sorting the row image data according to the plurality of gray scale voltages and generating sorting labels representative of a scanning order of gate lines; and a scanning display module for sequentially scanning the gate lines according to the sorting labels to display the image to be displayed.

16. The display device according to claim 15, wherein the display device further comprising a judgment module;

the judgment module for judging whether the image data of the image to be displayed being the image data of an overload image or not; and the acquisition module for acquiring the gray scale voltage corresponding to the row image data in the image data, if the image data of the image to be displayed is the image data of the overload image.

17. The display device according to claim 15, wherein the sorting generation module is for sorting of the row image data and generating the sorting labels according to the plurality of gray scale voltages from large to small values.

18. The display device according to claim 15, wherein sorting generation module is for sorting of the row image data and generating the sorting labels according to the plurality of gray scale voltages from small to large values.

19. The display device according to claim 15, wherein the sorting generation module further comprising:

a voltage judgment sub-module for judging whether a plurality of row image data in the image data having the row image data with the same value of the plurality of gray scale voltages; and a sorting sub-module for sorting the row image data with the same value of the plurality of gray scale voltages in accordance with an order of original image row numbers, if the plurality of the row image data in the image data having the row image data with the same value of the plurality of gray scale voltages, wherein the original image row numbers are the row number of the row image data in the image data.

20. The display device according to claim 16, wherein the judgment module further comprising:

a judgment sub-module for judging whether the ratio of the number of overload sub-pixels to the total number of sub-pixels in the image to be displayed exceeding a preset ratio or not, wherein the overload sub-pixels are the sub-pixel with a difference of the gray-scale values between its adjacent sub-pixel exceeding a preset threshold of each row of the sub-pixels; and a determination sub-module for determining the image data of the image to be displayed being the image data of the overload image, if the ratio exceeding the preset ratio.

* * * * *